United States Patent [19]

Hicks

[11] Patent Number: 4,602,721

[45] Date of Patent: Jul. 29, 1986

[54] MULTIPLE ACCESS NEWSPAPER RECEPTACLE

[76] Inventor: Robert R. Hicks, 1384 Shoop Ave., Wauseon, Ohio 43567

[21] Appl. No.: 658,159

[22] Filed: Oct. 5, 1984

[51] Int. Cl.[4] ..... B65D 43/14; B65D 51/04

[52] U.S. Cl. ..... 220/337; 232/43.1; 232/43.4

[58] Field of Search ..... 220/334, 337, 338; 232/43.1, 43.4

[56] References Cited

U.S. PATENT DOCUMENTS 1,557,454 10/1925 Hammer ..... 220/337

3,236,408 2/1966 McFadden et al. ..... 220/337

3,927,792 12/1975 Andrade ..... 232/43.4

*Primary Examiner*—George T. Hall

*Attorney, Agent, or Firm*—George R. Royer

[57] ABSTRACT

The subject invention is a multiple access newspaper receptacle, which comprises, in general, a longitudinally extending housing with a correspondingly internally disposed hollow chamber, having a dual entry access to said hollow chamber. First, there is a hinged door for entrance from the front of the box, with a second access door on either the sides, back, or front of said mailbox.

1 Claim, 5 Drawing Figures

MULTIPLE ACCESS NEWSPAPER RECEPTACLE

DISCUSSION OF PRIOR ART AND BACKGROUND OF INVENTION

The foremost and primary application of the subject invention is the newspaper receptacles. Other relevant applications include parcel drop boxes, wherein the user must extract the contents after a deposit therein of specified types of articles. The invention additionally has other applications to containers used in business or other purposes for intermediate or temporary storage of items intended for later usage. In this respect, since the primary application of this invention is to the manufacture and construction of newspaper receptacles used primarily in rural or suburban areas, the following discussion will be directed mainly to this type of container, with the understanding that the background will be substantially similar for the other types of devices and that the invention has such wider applicability.

The construction and usage of newspaper receptacles of the type use primarily in rural or suburban areas differs significantly from those used in older urban areas. In this respect, in urban areas of moderate or large-sized cities, newspaper receptacles are usually appended directly to a dwelling, and as such they are generally offset from the road, generally distal from the roadway on which the dwelling is located. In comparison, newspaper receptacles in rural areas and many suburban areas are usually affixed above the ground on a vertical post positioned adjacent the road. In this respect, the newspaper receptacle door, or entranceway, is almost universally faced towards the doorway. The entrance doorway is usually emplaced extremely close to the edge of the roadway travelled by the delivery vehicle. Frequently, the adjacent roadway is a heavily-traversed thoroughfare, with vehicles passing at moderate to high speeds a relatively few feet from the receptacle entrance door. One can readily ascertain the relative danger to the patron by the proximity of the mailbox to the roadway traffic, in view of the fact that the user must step close to the roadway traffic in order to extract the newspaper from the receptacle. The potential for vehicular-pedestrian mishaps is substantial under such circumstances, and the threat of serious injury is a very real danger. The danger lies in the fact that the patron, or any family member who seeks to obtain the newspaper from the receptacle must step in front of the box to open the doorway and pull the paper out accordingly. Such a procedure normally entails the need to stand in front of the receptacle or close thereto. This aspect clearly presents a potential danger by reason of the close proximity to the roadway and the traffic thereon.

This invention is conceived as a means to overcome the foregoing problems and devise a receptable which avoids or alleviates, to a substantial degree, the potential for highway accidents involving persons who are extracting newspapers from a receptacle. The following objects of the subject invention are directed accordingly.

OBJECTS

It is an object of the subject invention to provide an improved newspaper or parcel receptacle;

Another object of the subject invention is to provide a newspaper receptacle which is safe to use of the type used in rural and suburban areas;

Still another object of the subject invention is to provide a receptacle which is safe to use when placing or removing the contents therefrom;

A further object of the subject invention is to provide an improved parcel receptacle;

Still another object of the subject invention is to provide an improved object receptacle of the type used close to highways;

Another object of the subject invention is to provide a multiple or variable access newspaper receptacle;

Yet another object of the subject invention is to provide an improved newspaper receptacle;

An object of the subject invention is to provide a receptacle which alleviates highway safety problems;

Other and further objects of the subject invention will become apparent from a reading of the following description taken in conjunction with the drawings.

DRAWINGS

DESCRIPTION OF GENERAL EMBODIMENT

The subject invention is a newspaper receptacle, a similar parcel receptor, which is adapted to have means to avoid the necessity of having the user stand in front of the receptacle and open the door thereof, near a roadway, in order to place therein or remove newspaper of other contents. In its most general form, the subject invention incorporates features of a secondary entranceway or doorway by which the user of the receptacle or other receptor can extract the contents, or emplace newspapers, etc., therein, without the need of standing in front of the doorway by the road edge. said second door may be equipped with a retaining mechanism, of variant form, which prevents such second doorway from being pushed open from the inside, thereby preventing any materials that are emplaced in the receptacle through the primary door from causing the secondary door to pen from the inside.

DESCRIPTION OF PREFERRED EMBODIMENT

Figure 2:
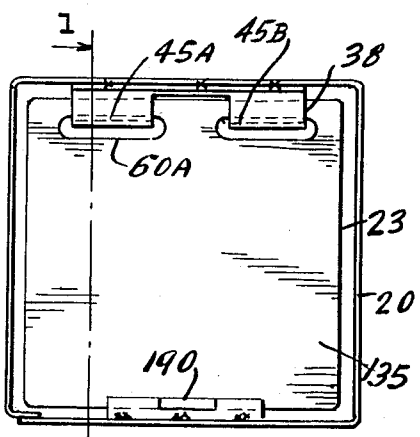
FIG. 2 is an end elevational view of the subject invention.
Figure 1:
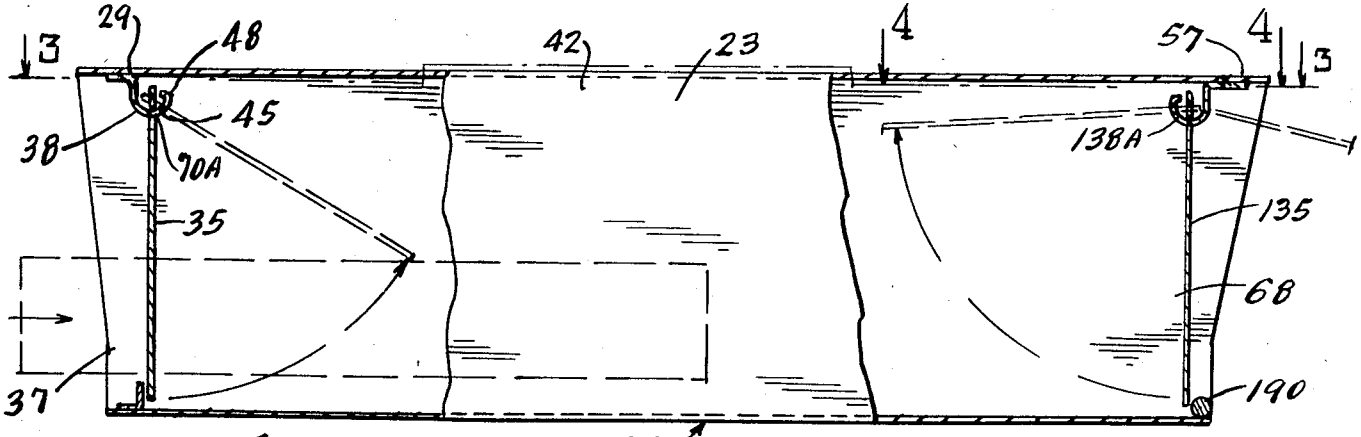
FIG. 1 is a side elevational view of the subjection invention shown partially in section.

Referring now to the drawings in which a preferred embodiment of the subject invention is shown, and particularly to FIGS. 1 and 2. In describing the subject invention, it is to be noted that the word "frontal" will be used in reference to those portions of the receptacle which are oriented towards or facing towards the roadway, while the words "rear" or posterior" will be used in reference to those areas of the receptacle which are facing generally away from the roadway. Moreover, it is to be stressed that in describing the subject invention, the following description will be directed to a limited number of particular embodiments, however, such description should not be considered to limit the scope of the invention and the following claims.

In FIG. 1, the receptacle 10, as shown, possesses some of the features of the conventionally structured newspaper receptacle, as seen on rural or suburban delivery routes. In particular, receptacle 10 comprises a longitudinally extending housing member 20, the interior of which is hollow in order to receive newspapers or other contents therein. In general, the interior chamber 23 of the receptacle housing 20 is of a longitudinal disposition usually conforming to the exterior configuration of the housing 20. Although this aspect is not critical to the utility of the housing.

The interior chamber of the housing 20 has a horzontally disposed floor 28, with a solid top 42 to cover the inside chamber to protect same from adverse climatology. Disposed on the frontal end 29 of the housing 20 is a pivotable door which is structured to conform to the shape of the front entranceway 37. Door 35 is pivotally mounted on its upper portion 58 to housing 20, as shown in FIGS. 1 and 2. As shown in FIGS. 1 and 2, there is integrally disposed on the upper inside surface 42 of the housing 20 a hinge member 45.

As seen in the drawings, the hinge member is located on the upper surface 42 just adjacent the frontal entranceway 37. As seen in FIG. 1, the hinge 45 is a hook-shaped member, not completely closed, with a resultant space between the end of the hook-shaped portion 48 and the upper inside surface 42 of the housing 20. Furthermore, as can be seen, the hook-shaped hinge member 45 faces reasonably away from the entranceway, as shown. In the embodiment shown in the drawings, the hinge 45 has two transverse hook portions 50A and 50B, although they may be continuous.

Figure 4:
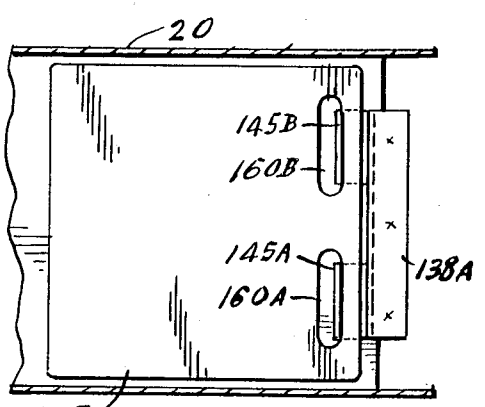
FIG. 4 is an end elevational view of the door device.
Figure 3:
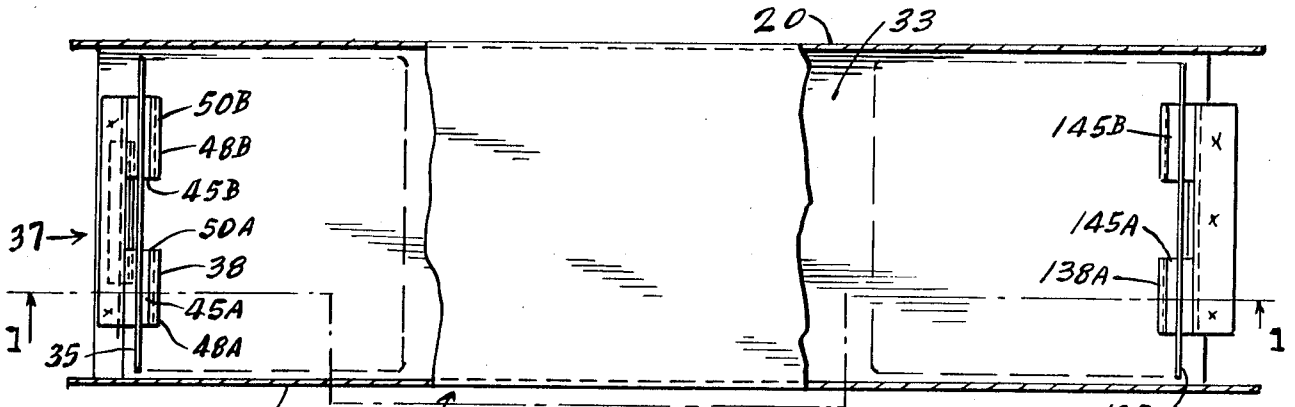
FIG. 3 is a top elevational view of the swivel post on which the receptacle in FIG. 1 is mounted as shown.
Figure 5:
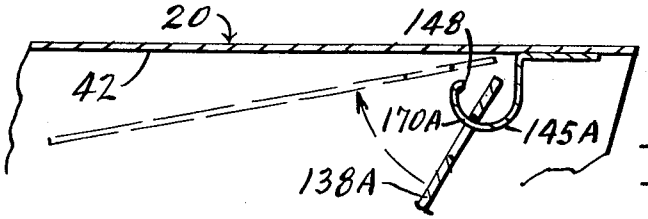
FIG. 5 is a side elevational view of the door attachment mechanism.

The genrally rectangularly shaped doorway 35 is equipped with transverse slotted openings 60A and 60B on the upper portion thereof, as seen in FIGS. 2 and 4. In particular, slotted openings 60A and 60B are adapted to be placed over the hook ends 45A and 45B of the hinge member 37, as seen in FIGS. 1 and 2. As the slotted openings 60A and 60B are placed over such hook ends, the surfaces 65A and 65B of the doorway 35 bordering the top of such slotted openings rest on the bottom part 70A and 70B of the hook 48A and 48B, as seen. Then when the door 35 is to be lifted off the hinge, it is pulled up off the hook portion and away therefrom towards the rear of the box, as depicted in FIG. 5.

As an optional feature, a magnet 80 is emplaced at the bottom of the doorway 35, as seen in FIG. 2 to keep the door in the vertical position.

Disposed on the rear position of the receptacle shown in FIG. 1, is a rearwardly facing doorway 135, pivotally mounted to the rear of housing 20, as shown in FIG. 1. Such rearwardly facing doorway 135 is constructed with the same hinging features as the frontal doorway 35, with neither being capable of being moved outwardly from the housing 20

While specific embodiments of the subject invention have been shown and described, it is to be stressed herein that a description of such specific embodiments shall not to be construed as limiting the scope of the following claims, as other conceivable embodiments are envisioned within the scope of the invention.

I claim:

1. A newspaper materials receptacle with a frontal end and a posterior end, for receiving and holding temporaily materials for eventual withdrawal of such newspaper materials from said member, comprising:

(a) a hollow housing member having a hollow inner chamber having a frontal end and a posterior end, said receptacle having an entranceway on the frontal end of said housing, and an entranceway on the posterior portion of said housing, said housing member having an inner upper surface on the hollow inner chamber;

(b) hinge means on the inner upper surface of said housing member on the respective frontal and posterior ends thereof, wherein said hinge means has a hook-shaped extension depending downwardly from said upper inner surface and wherein said hook means has a gap between the end thereof and said upper inner surface;

(c) doorway means on both the frontal end and posterior end of said housing member, wherein each said doorway means has slotted opening means to fit over the said hinge means on the respective posterior and frontal ends of said housing;

(d) retaining means adapted to prevent the respective doorway means from being opened from the inside of said housing member.

* * * * *